United States Patent [19]

Denny et al.

[11] Patent Number: 4,762,431

[45] Date of Patent: Aug. 9, 1988

[54] MODIFIED THERMAL PRINTING USING A HEATED ROLLER AND WITH LIFT-OFF CORRECTION

[75] Inventors: Clifford M. Denny; Hugh T. Findlay, both of Lexington; Stephen A. Popyach, Harrodsburg; Deh C. Tao, Lexington, all of Ky.

[73] Assignee: International Business Machines Corporation, Armonk, N.Y.

[21] Appl. No.: 856,528

[22] Filed: Apr. 28, 1986

[51] Int. Cl.[4] ..... B41D 3/20

[52] U.S. Cl. ..... 400/120; 400/198; 400/641; 400/696; 346/76 R

[58] Field of Search ..... 400/120, 198, 695, 696, 400/697, 697.1, 55, 56, 57, 185, 225, 248, 637.1, 639, 639.1, 641; 346/76 R, 76 L, 76 PH

[56] References Cited

U.S. PATENT DOCUMENTS

| | | | |
|---|---|---|---|
| 2,057,696 | 1/1934 | Sherman | 400/120 |
| 4,384,797 | 8/1981 | Anderson et al. | 400/696 |
| 4,396,308 | 8/1983 | Applegate et al. | 400/696 |
| 4,545,693 | 10/1983 | Bartlett et al. | 400/120 |
| 4,572,687 | 2/1986 | Croley et al. | 400/696 |
| 4,639,152 | 1/1987 | Yamamoto et al. | 400/120 |
| 4,651,162 | 3/1987 | Nakamura et al. | 400/120 X |
| 4,654,674 | 3/1987 | Hibino et al. | 400/697.1 |
| 4,661,824 | 4/1987 | Kuge | 346/76 PH |
| 4,700,200 | 10/1987 | Hibino | 346/76 PH |

FOREIGN PATENT DOCUMENTS

| | | | |
|---|---|---|---|
| 0106663 | 4/1984 | European Pat. Off. | 346/76 R |
| 0161947 | 12/1979 | Japan | 400/120 |
| 0061579 | 4/1982 | Japan | 400/120 |
| 0129770 | 8/1982 | Japan | 400/198 |
| 0201681 | 12/1982 | Japan | 400/55 |
| 0018283 | 2/1983 | Japan | 400/120 |
| 0076276 | 5/1983 | Japan | 400/120 |
| 0087072 | 5/1983 | Japan | 400/695 |
| 0185278 | 10/1983 | Japan | 400/120 |
| 0219071 | 12/1983 | Japan | 400/120 |
| 0067065 | 4/1984 | Japan | 400/120 |
| 0078878 | 5/1984 | Japan | 400/120 |
| 0224378 | 12/1984 | Japan | 400/248 |
| 0129287 | 5/1985 | Japan | 400/120 |
| 0101058 | 6/1985 | Japan | 400/57 |
| 0131260 | 7/1985 | Japan | 400/120 |
| 0189460 | 9/1985 | Japan | 400/120 |

OTHER PUBLICATIONS

IBM Technical Disclosure Bulletin, "Motor Drive Arrangement for Ribbon Feed and Printhead Positioning Control", Applegate et al., vol. 25, No. 11B, Apr. 1983, pp. 6236–6238.

*Primary Examiner*—Ernest T. Wright, Jr.
*Attorney, Agent, or Firm*—John A. Brady

[57] ABSTRACT

Roller 1 is heated to a temperature at which correctable thermal printing is caused to be better fixed to the paper and to be darker, while lift-off correction may be subsequently conducted. Roller 1 is spaced from printhead 3 a distance sufficient to permit reading of immediately prior typing. Both roller 1 and printhead 3 are mounted on carrier 5.

1 Claim, 1 Drawing Sheet

MODIFIED THERMAL PRINTING USING A HEATED ROLLER AND WITH LIFT-OFF CORRECTION

TECHNICAL FIELD

This invention relates to the modification of thermal printing after the printing is effected, the modified printing remaining correctable by lift-off correction.

This is an improvement in the field of thermal lift-off correction described and claimed in U.S. Pat. No. 4,384,797 to Anderson et al, which is assigned to the same assignee to which this application is assigned. As there described, the outer layer of a ribbon adheres to printing at temperatures intermediate room temperatures and printing temperatures. After some cooling, a bond exists between the printing and the ribbon by which the printing is lifted away as the ribbon is moved from contact with the printing.

BACKGROUND ART

The foregoing U.S. Pat. No. 4,384,797 to Anderson et al is directed generically to this lift-off correction at intermediate temperatures. Subsequent enhancements to such lift-off correction are described in the prior art. For example, U.S. Pat. No. 4,545,693 to Bartlett et al, discloses and claims employing a series of pulses to effect the lift-off correction.

Resistive ribbon printing from a ribbon suitable for lift-off correction is subject to being rubbed off the paper on which it is printed. Actual abrasion resistance depends upon the overall system involved, including the characteristics of the thermal ink, the manner of printing, and the characteristics of the paper or other substrate printed upon. A general improvement of abrasion resistance for such systems permits a wider use of thermal printing and is a factor permitting other elements of the system to be modified as may be desirable.

This invention employs moderate heating subsequent to printing to modify the resistance of printed characters to rubbing and other abrasion and to modify the appearance of the printed characters. The heated printing is typically darker and appears heavier. Surprisingly, such moderate heating does not destroy the quality of being capable of lift-off correction, and the heat is therefore applied after printing without regard to the fact that a subsequent lift-off erase operation may be conducted. U.S. Pat. No. 2,057,696 to Sherman shows general heating of a transfer medium to facilitate printing. This description has no indication of the possibility of lift-off correction. Heat fixing in copier technology is a post imaging step to harden an ink image.

DISCLOSURE OF THE INVENTION

This invention employs the discovery that temperatures can be found at which the printing is better fixed to the paper or other substrate for abrasion resistance, while lift-off correction is not impaired.

In accordance with the this invention, heat is applied to thermally applied printing, preferably by a heated roller mounted with the printhead. The heating implement is preferably spaced past the print point a distance sufficient to leave the last two or three typed words unobstructed for immediate reading of material being typed. In a typical application, brief application of temperatures between 80 and 85 degrees C. is effective.

The resulting printing is significantly enhanced in resistance to being rubbed from the paper. At the same time, surprisingly, lift-off correction by a bonding ribbon at intermediate heat is not impaired. Additionally, the resulting printing is notably darker.

BRIEF DESCRIPTION OF THE DRAWING

The details of this invention will be described in connection with the accompanying drawing, in which.

BEST MODE FOR CARRYING OUT THE INVENTION

Figure 2:
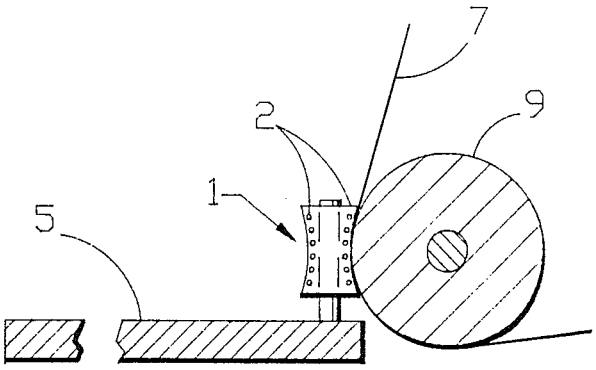
FIG. 2 is an illustrative, fragmentary sectional view taken along line 2—2 of FIG. 1 omitting all elements on the carrier except the heating roller.

Preferably, the heating implement is a simple, freely rotating roller 1 as shown in the figures, which may be a solid perfluoroethylene resin or silicone rubber shaped to conform with the printing surface. Roller 1 is heated by an internal electrical resistance element 2, (shown in cross-section FIG. 2). In a typical system, element 2 brings the surface of roller 1 to a temperature of 80 to 85 degrees C. The heated surface of roller 1 covers printing in one line and roller 1 typically may be about $\frac{1}{4}$ inch (about 0.63 cm) in height. The diameter of roller 1 is not significant so long as heat is applied with pressure as will be described.

Printhead 3 may be a typical resistive ribbon printhead, and both roller 1 and printhead 3 are mounted on a carrier 5 which traverses paper 7 mounted on a platen 9 of generally standard cylindrical configuration. Pinch rollers 11 and 13, mounted on carrier 5 spaced away from the area of printing, receive ribbon 15. The entire system except for roller 1 is basically as described in the foregoing U.S. Pat. No. 4,384,797 to Anderson et al.

Print ribbon 15 passes over printhead 3 and then extends to pinch rollers 11 and 13. Pinch rollers 11 and 13 thereby direct ribbon 15 away from the area immediately past the printing so that the last characters typed, preferably the number of characters in about two words of typical English text, are visible. Roller 1 is spaced from printhead 3 so as to also leave those last characters typed visible. Roller 1 is mounted close to platen 9 and has a concave surface conforming to the cylindrical surface of platen 9 so that it continually presses paper 7 into platen 9, thereby heating the printing on that paper 7.

Figure 1:
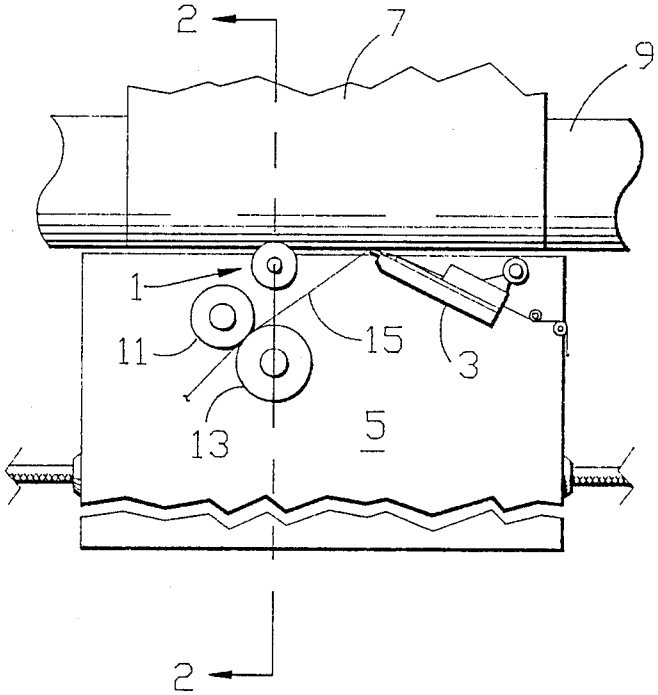
FIG. 1 is an illustrative, fragmentary plan view of the elements of the preferred implementation of this invention

Roller 1 is held in place relative to platen 9 except that it is withdrawn for paper insertion, as is standard. (Illustrative mechanisms showing a printhead and a guide member moveable toward and away from a platen are shown in *IBM Technical Disclosure Bulletin,* Vol. 25, No. 11B, April 1983, pp. 6236–6238 in an article entitled "Motor Drive Arrangement for Ribbon Feed and Printhead Positioning Control.") Since during pauses in typing roller 1 rests upon completed printing, roller 1 is not heated during pauses in typing. At the initiation of printing after a pause, carrier 5 is typically moved backward (to the left in FIG. 1) so that it will have a sufficient distance for acceleration to obtain the desired constant velocity before reaching the next print location. During such a backward operation, electrical current is applied to roller 1 so that it reaches the predetermined temperature when the new printing is initiated. Roller 1 is continuously heated as printing continues, and movement of carrier 5 necessarily moves roller 1 against characters which have been printed. (Alternatively roller 1 may be moved away from platen 9 during pauses in typing and heated during the pauses. Similarly, roller 1 may be moved away from platen 9 during pauses if residual heat tends to unduly affect print upon which it rests.)

Lift-off correction may be conducted as described in the foregoing U.S. Pat. No. 4,384,797 and is entirely effective even when the heated roller 1 has passed over the character to be erased. With a soft silicone rubber roller 1 pressing against the printing at 120 pounds per square inch (about 8.4 kilograms per square centimeters) and moved at three inches per second (about 7.6 centimeters per second) abrasion resistance is very good at 80–85 degrees C. and correction is 100 percent (i.e. all observable print is removed). At 85–90 degrees C. abrasion resistance is very good and correction is 99 percent (i.e. observable area covered by print is reduced to 1 one hundredth of the observable area of the print immediately before erasure). Of course, at higher temperatures abrasion resistance increases, but correction percent drops significantly. (Such characterizations are based on visual observation and are therefore subjective.)

Lift-off correction ink is necessarily capable of being physically separated from the paper it is printed upon and therefore such printing can be removed by some level of abrasion short of damage to the paper. Typically in accordance with this invention, abrasion resistance is significantly improved such that printing is not significantly abraded by normal handling and use of printed materials. In a typical application, about 37 percent of printing was abraded off by a rotary abrader, while only 2 percent was removed of otherwise-substantially-identical printing having been heat treated with roller 1 at 80–85 degrees C., 120 psi, and 3 ips as just described. A similar comparison with several different papers typically found darker printing after the heat treatment, with the average change in amount of ink coverage for one pattern changing from Geometric Index of 61.7 in the absence of this invention to Geometric Index of 69.4 for printing having been heat treated with roller 1 at 80–85 degrees C., 120 psi, and 3 ips as just described. (Geometric Index is a measure of coverage and regularity of edges. An image analyzer determines character area and length of all edges. Actual character area is divided by actual perimeter squared. That quantity is then divided by the quantity of ideal character area divided by ideal perimeter squared. Ragged line and internal voids add to the actual perimeter, which tends to reduce the Geometric Index.)

It will be recognized that this invention may be used with thermal printers generally which transfer ink by applying heat to flow the ink. The foregoing embodiment is primarily illustrative and patent coverage should be as provided by law, with particular reference to the accompanying claims.

We claim:

1. A thermal printer having a lift-off correction capability by applying heat at temperatures less than printing temperatures, a printhead for printing from a thermal transfer ribbon, a platen having a cylindrical surface to support paper being printed upon on said cylindrical surface, a ribbon feed system for directing said ribbon away from said printhead after printing, a carrier on which said printhead is mounted to traverse said platen for printing on said paper, and a heated roller having a concave outer surface which conforms to said cylindrical surface of said platen mounted on said carrier in a fixed, spaced position past the location of printing by said printhead a distance to leave at least the last two to three typical words printed by said printhead visually unobstructed, said roller pressing directly against printing transferred by said printhead from said ribbon, said roller operating at a temperature above ambient, below said printing temperatures, and below a temperature which impairs said lift-off correction capability.

* * * * *